US005746545A

United States Patent [19]

Parker, Jr.

[11] Patent Number: 5,746,545

[45] Date of Patent: May 5, 1998

[54] GROUND STABILIZATION STRUCTURE

[75] Inventor: S. Alex Parker, Jr., Maysville, Ky.

[73] Assignee: Parco Industries, Maysville, Ky.

[21] Appl. No.: 626,360

[22] Filed: Apr. 2, 1996

[51] Int. Cl.[6] ..... E02B 3/12

[52] U.S. Cl. ..... 405/258; 405/16; 405/19; 404/35

[58] Field of Search ..... 405/258, 15–17, 405/19; 404/32, 35, 40; 24/3.6, 908

[56] References Cited

U.S. PATENT DOCUMENTS

| | | | |
|---|---|---|---|
| 482,670 | 9/1892 | Ackerman | 29/3.6 |
| 3,764,446 | 10/1973 | Martin . | |
| 4,142,821 | 3/1979 | Doring . | |
| 4,188,153 | 2/1980 | Taylor . | |
| 4,196,694 | 4/1980 | Buchanan . | |
| 4,801,217 | 1/1989 | Goldberg . | |
| 5,131,787 | 7/1992 | Goldberg | 404/35 |
| 5,370,475 | 12/1994 | LeBlanc . | |

FOREIGN PATENT DOCUMENTS

| | | | |
|---|---|---|---|
| 2643400 | 8/1990 | France | 405/19 |
| 23 51 701 | 4/1975 | Germany | 405/16 |
| 5381264 | 1/1980 | Japan . | |
| 0075014 | 6/1980 | Japan | 405/258 |
| 0101932 | 6/1983 | Japan | 405/258 |
| 0106020 | 6/1983 | Japan | 405/258 |

*Primary Examiner*—Tamara L. Graysay
*Assistant Examiner*—Frederick L. Lagman
*Attorney, Agent, or Firm*—Wood, Herron & Evans LLP

[57] ABSTRACT

A ground stabilization structure having a plurality of rings secured together at peripherally adjoining surfaces by helical coil fasteners. The rings are arranged in a two dimensional array and the rings may be folded into a stack to provide for easy transportation of the structure. Preferably, the rings are tire beads cut from the rim of a waste tire and having a rigid wire support member embedded therein. The helical fasteners have a diameter sufficient to allow two rings to lie substantially flat on a ground surface with the peripheral surfaces of the rings contacting each other. The diameter of the coil also permits two adjacent secured rings to be folded upon each other to form a stack. A method of forming a ground stabilization structure is also provided in which the helical coils are threaded onto the rings at their peripheral junctions to form a two dimensional array.

12 Claims, 2 Drawing Sheets

GROUND STABILIZATION STRUCTURE

FIELD OF THE INVENTION

The present invention generally relates to ground stabilization structures and, more particularly, to a ground stabilization structure made from a plurality of rings bound together by a plurality of helical coils and a method for making the same.

BACKGROUND OF THE INVENTION

Various approaches have been utilized to prevent hillside erosion and landslides. For example, some hillsides are terraced using concrete or wooden members such as railroad ties. Additionally, grass or plants may be planted between the structures. These methods of stabilization, however, can be quite expensive and time consuming due to implementation and maintenance costs.

Waste tire disposal has also become a major problem. Cost efficient recycling methods and/or uses for waste tires are in continuing demand. One of these recycling methods involves cutting the tire beads from the sidewall of the tire and grinding or shredding the rubber portion of the tire. Because the tire bead includes a rigid metal ring embedded therein, this portion of the tire cannot be recycled and is usually discarded in a landfill.

Another tire recycling method involves using whole tires for ground stabilization devices. Ground stabilization devices which utilize discarded whole automobile tires have been proposed but have various drawbacks which might hinder their widespread acceptance. Whole tires bound together with ties, bolts, and clamps are disclosed in U.S. Pat. No. 4,188,153 issued to Taylor and U.S. Pat. No. 5,370,475 issued to LeBlanc.

As shown in these prior patents, whole tires are bound together at their peripherally contacting surfaces to form a mat structure. The assembly is placed on a hillside to prevent erosion. One problem with using whole tires is that they are difficult to completely fill with dirt, and the unfilled cavities provide a breeding place for rodents. Additionally, the uneven nature of the terrain which results from partially filled tires makes mowing grass on the hillside difficult. Furthermore, ground stabilization mats made from whole tires are bulky and heavy, making transportation of the mats difficult. Therefore, the individual tires forming these mats usually must be bound together at the job site.

Due to the problems mentioned above associated with using ground stabilization mats constructed from whole tires, alternative ground stabilization structures have been proposed that utilize portions of old tires. U.S. Pat. No. 4,142,821 issued to Döring discloses a ground stabilization structure that addresses the unfilled cavity problem associated with using whole tires. Döring U.S. Pat. No. 4,142,821 discloses using the annular tread strips of old automobile tires with the sidewalls of the tires removed to form a ground stabilization device. The tread strips are bound together by rivets, screws, clamps, or wire to form a ground stabilization device.

While the device disclosed by Döring U.S. Pat. No. 4,142,821 addresses the filling problem mentioned above, this method also presents certain disadvantages. Most notably, a mat formed from only the tire treads will have less rigidity than is required to adequately stabilize the ground. If a mat made from tire treads is placed on a hillside, heavy erosion could cause the treads to sag and the mat to stretch in the direction of the eroding dirt.

U.S. Pat. No. 4,801,217 issued to Goldberg discloses a stabilization mat used for road construction made from discarded tire beads. Goldberg U.S. Pat. No. 4,801,217 further discloses that the mat is assembled at the job site by tying together the individual tire beads with tire casing strips tied into a square not around adjoining tire beads.

The device disclosed by Goldberg and all of the prior devices in this area, however, further suffer from the disadvantage of being difficult to assemble and, once assembled, difficult to transport. The fastening elements previously used may either be so loose that an inadequate connection is made between adjacent ring members, or so rigid that the mats can only be assembled at the job site.

It would therefore be desirable to provide a low profile ground stabilization structure utilizing tire beads and having sufficient rigidity to withstand heavy hillside erosion. It would also be desirable to provide a ground stabilization structure which is easily assembled, folded and transported to the job site.

SUMMARY OF THE INVENTION

The present invention generally provides a ground stabilization structure or mat formed from a plurality of rings and a plurality of helical coil fasteners. The helical coil fasteners secure the rings together at peripherally adjoining surfaces. Fastening the rings together in this manner forms a two dimensional array of rings, which in turn forms a ground stabilization mat.

In accordance with one important aspect of this invention, the rings are continuous circular tire beads cut from the rim of a tire. Generally, the cross section of a tire bead is curved and includes an embedded wire support member to provide rigidity to the tire bead. This also provides advantageous rigidity to the ground stabilization mat.

The helical coil is preferably made of metal wire, and more preferably, a metal that is corrosion resistant. Alternatively, the metal wire could be coated with rubber or plastic to provide corrosion resistance. Also, the coil is spring-like and comprises several turns. The coil is resilient with spaces between adjacent turns to facilitate mounting of the coils to the rings. The rings are mounted to the coils by threading the coil from one end of the helical coil until the helical coil fully encircles the tire bead.

Preferably, the two dimensional array of rings comprises perpendicular rows and columns of rings secured at their peripheral surfaces by the helical coils. In accordance with the present invention, however, other two dimensional arrays may be formed to provide ground stabilization structures. For example, an array of rings may be formed generally in the shape of a triangle or circle.

In accordance with an important aspect of the present invention, the helical coil fastener is sized to permit the two dimensional array of rings to be folded in one direction to form a stack of rings. More specifically, the inner diameter of the helical coils permits two rings that are bound together to lie substantially flat on a ground surface and one of the rings to be freely folded upon the other to form a stack.

In use, when the rings are folded into a stack, they can be easily transported to a job site. After the rings are transported to the job site, the stack is unfolded into a two dimensional array and placed on a ground surface, such as a hillside, requiring stabilization.

The present invention also provides a method for forming a ground stabilization structure comprising a two dimensional array of rings bound together at peripherally adjoining surfaces. The method comprises threading a helical coil onto a first ring and securing the first ring to a second ring by threading the helical coil onto the second ring. A two dimensional array of rings is formed by securing additional rings to the first and second rings with helical coils at the abutting peripheral adjoining surfaces of the rings.

Several important advantages of the present invention will be appreciated from the foregoing summary. While some of these main advantages have been mentioned above, those of ordinary skill in the art will readily recognize many more of the advantages and objectives of the present invention upon reviewing the detailed description of the specific embodiments taken in conjunction with the accompanying drawings.

DETAILED DESCRIPTION OF SPECIFIC EMBODIMENTS

Figure 1:
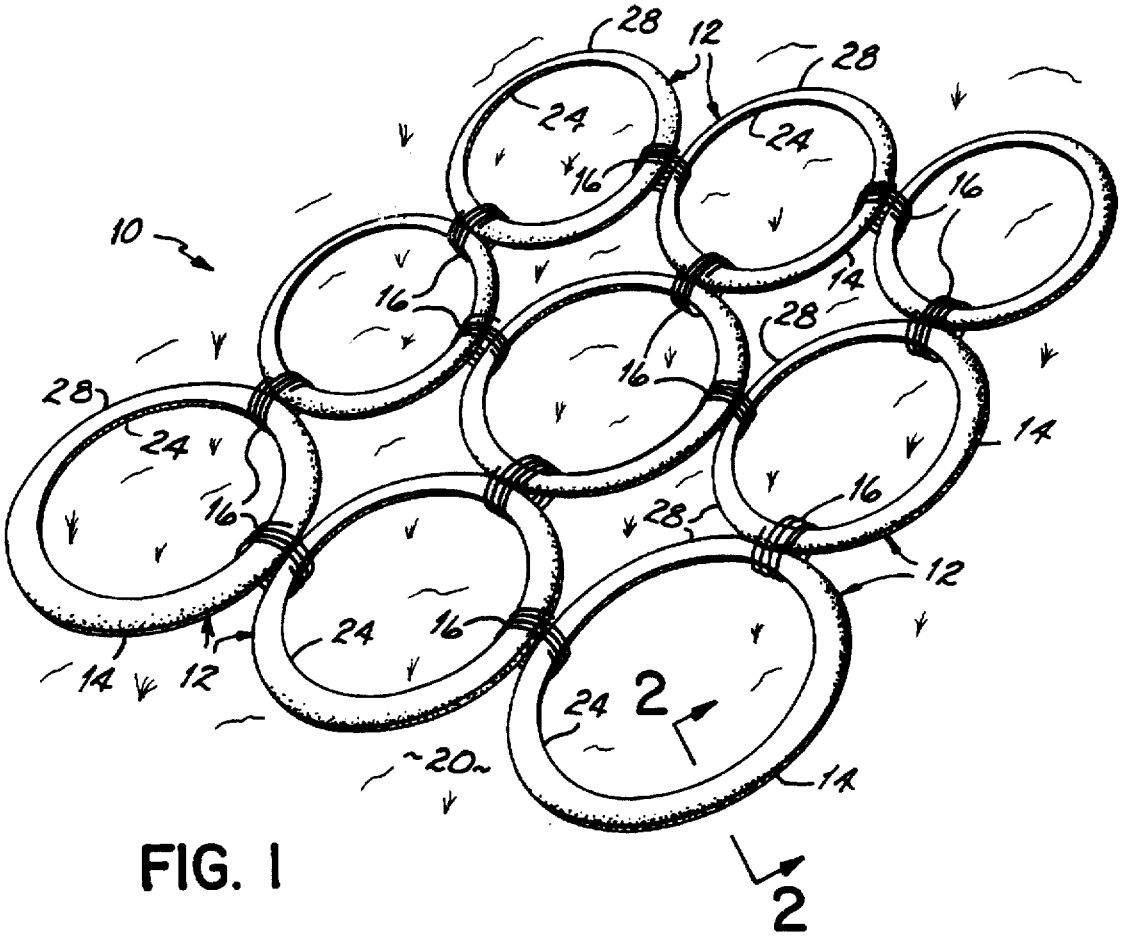
FIG. 1 is a perspective view illustrating a ground stabilization structure in accordance with a preferred embodiment of the present invention.

Referring first to FIG. 1, a ground stabilization structure or mat 10 is shown in accordance with an embodiment of the present invention. The ground stabilization structure 10 includes a plurality of rings 12 secured together at their abutting peripheral surfaces 14 with coil fasteners 16 to form a two dimensional array. The ground stabilization structure or mat 10 is placed on a ground surface 20, such as a downwardly sloping ground surface such as a hillside.

The fasteners 16 are helical coils, preferably made of metal wire. The metal wire may be a corrosion resistant metal, or the wire may be coated with rubber or plastic. The rings 12 are preferably continuous circular tire beads cut from the rim of a waste tire (not shown). Typically, the tire beads 12 are a waste product formed during a recycling operation in which the tire beads 12 are cut from the sidewalls of a tire.

Figure 2:
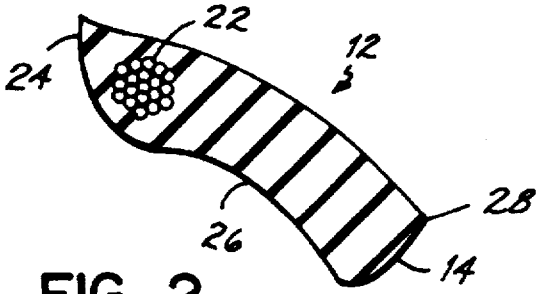
FIG. 2 is a cross sectional view of a ring taken along line 2—2 of FIG. 1.

Referring now to FIG. 2, which shows a cross sectional view of tire bead 12, the tire bead 12 includes a continuous wire support member 22 embedded in an inner edge portion 24 of the tire bead 12. The tire bead 12 is generally curved in cross section, having a curved flange 26 extending from the inner edge portion 24 of the tire bead 12 and ending at an outer peripheral edge 28. The curved flange 26 extends about 1 to 3 inches from the inner edge 24 to the outer peripheral edge 28 of the tire bead 12.

The helical coils 16 have an inner diameter large enough to encircle two adjacent rings 12 that are lying substantially flat on the ground and touching at their peripheral surfaces 14. The inner diameter of the helical coil also permits two adjacent rings that are bound together to be freely rotated upon each other to form a stack, as will be discussed below. For example, if each ring 12 measures 1.25 inches from inner edge 24 to outer peripheral edge 28, the inner diameter of the helical coil 16 is about 2.25 to 2.75 inches to allow two rings adjacent rings that are fastened together 12 to lie substantially flat when the stabilization structure is placed on a ground surface 20.

Figure 3:
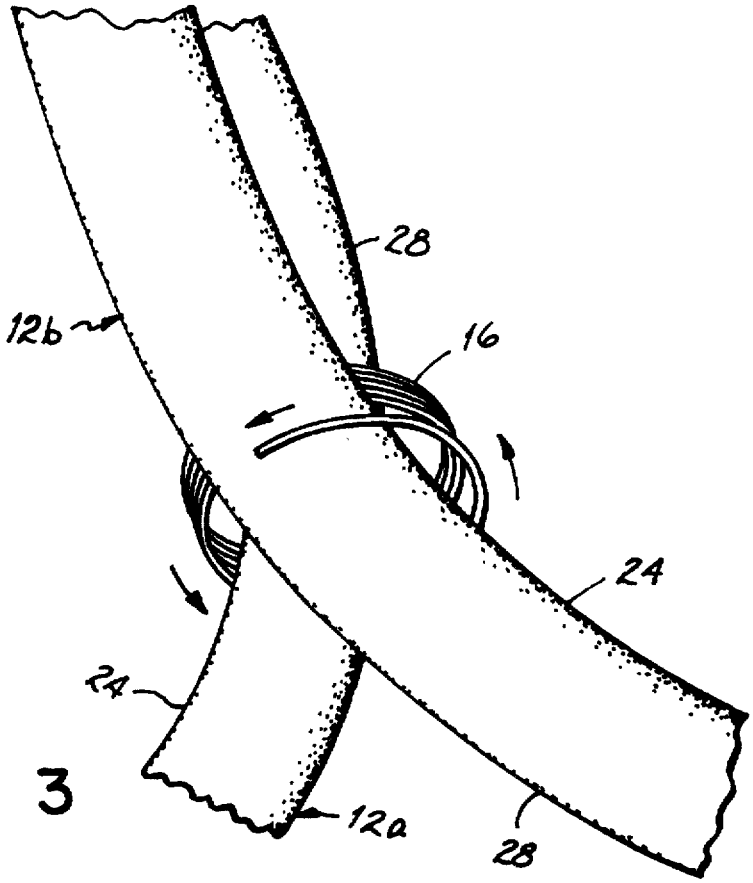
FIG. 3 is a fragmented perspective view illustrating a connection.

A method of forming the ground stabilization structure 10 is also provided in accordance with the principles of the present invention. Referring now to FIG. 3, the method of forming the ground stabilization structure 10 includes threading the helical coil 16 onto a first ring **12*a*. After the helical coil 16 has been secured to the first ring 12*a*, the helical coil 16 is threaded onto a second ring 12*b*. This secures the first ring 12*a* and the second ring 12*b*** together in a positive manner while allowing the rings to pivot through 360° with respect to each other.

A ground stabilization structure is formed by securing additional rings 12 to the first ring **12*a* and the second ring 12*b*. The ground stabilization structure or mat 10 includes a plurality of tire beads 12 secured at their peripherally abutting surfaces 14 with helical coil fasteners 16. Preferably, a two dimensional array of rings 12 includes a number of perpendicular rows and columns of the rings 12, as shown in FIG. 1. However, virtually any two dimensional array of rings 12 may be utilized to form the ground stabilization structure 10**.

Figure 4:
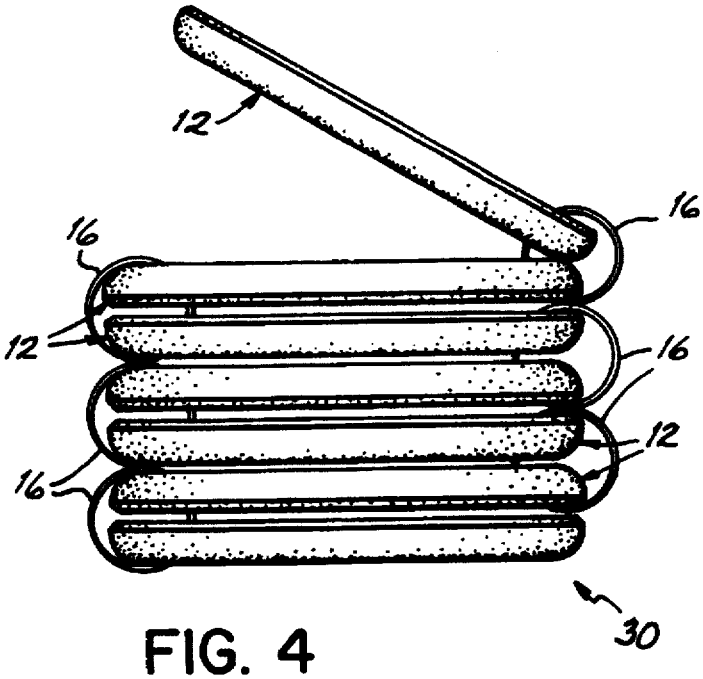
FIG. 4 is a side elevational view of a ground stabilization structure illustrating the plurality of connected rings folded into a transportable stack.

Referring now to FIG. 4, the present invention provides for a two dimensional ground stabilization structure that allows the rings 12 to be folded in one direction into a stack 30. As mentioned above, the inner diameter of the helical coil 16 is large enough to allow two rings 12 to lie substantially flat on the ground with the rings contacting at their peripheral surfaces 14. The inner diameter of helical coil also permits two attached rings 12 to be freely folded upon each other.

Therefore, a row of rings 12 may be folded upon an adjacent row of rings 12. As shown in FIG. 4, seven rows of rings 12 have been folded into a stack although, of course, this number of rings 12 may vary. Alternatively, a column of rings 12 could be folded upon an adjacent column of rings 12 to form the stack 30.

The ground stabilization structure 10 may be formed by securing rings 12 together at the job site and placing the ground stabilization structure 10 on a ground surface, such as a hillside. Preferably, however, the ground stabilization structure 10 can be preassembled into a two dimensional array and folded in one direction into a stack 30 of rings 12 as shown in FIG. 5. After the rings have been folded into a stack 30, the stack 30 can be easily transported to the job site. At the job site, the rings 12 are then unfolded into a two dimensional array and placed onto a ground surface such as a hillside.

While the present invention has been illustrated by a description of various embodiments and while these embodiments have been described in considerable detail, the scope of the appended claims should not be restricted or in any way limited by such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A ground stabilization structure comprising:

a plurality of rings placed in abutting relation to one another, said rings being formed of continuous circular tire beads cut from the rims of tires;

a plurality of fasteners securing adjacent, abutting rings together, said fasteners formed by helical coils with each coil surrounding abutting ring portions at a junction between two adjacent rings;

the helical coils being operably configured for securing adjacent abutting rings together when substantially flat on a ground surface and further for providing rotation of a ring onto an adjacent ring for forming a stack of rings.

2. The ground stabilization structure of claim 1 wherein said tire beads are generally curved in cross section.

3. The ground stabilization structure of claim 1 wherein said tire bead includes an embedded wire support member.

4. The ground stabilization structure of claim 1 wherein said helical coil is a metal wire.

5. The ground stabilization structure of claim 4 wherein said helical coil of metal wire is corrosion resistant.

6. A method for forming a ground stabilization structure comprising the steps of:

positioning, adjacent to each other, a first ring and a second ring formed of continuous circular tire beads cut from the rims of tires:

securing a helical coil to the first ring by threading said helical coil onto the first ring; and, securing said first ring to the second ring by threading said helical coil onto the second ring;

the helical coil being operably configured for providing rotation of the first ring onto the second ring to form a stack of rings.

7. The method of claim 6, further comprising the step of:

securing additional rings to said first and second rings to form a two dimensional array by threading additional helical coils onto said rings at peripheral abutting surfaces thereof.

8. The method of claim 7, further comprising the steps of:

folding said two dimensional array of rings into said stack;

transporting said rings to a site requiring ground stabilization;

unfolding said stack of rings into said two dimensional array; and placing said two dimensional array on an inclined ground surface requiring stabilization.

9. The method of claim 7 wherein said helical coil is a metal wire.

10. The method of claim 9 wherein said helical coil of metal wire is corrosion resistant.

11. The method of claim 6 wherein said tire beads are generally curved in cross section.

12. The method of claim 6 wherein said tire bead includes an embedded wire support member.

* * * * *